United States Patent [19]

Sedlmair

[11] 4,082,314

[45] Apr. 4, 1978

[54] FRONT JAW FOR SAFETY SKI BINDINGS

[75] Inventor: Gerhard Sedlmair, Farchant, Germany

[73] Assignee: Hannes Marker, Garmisch-Partenkirchen, Germany

[21] Appl. No.: 778,970

[22] Filed: Mar. 18, 1977

[30] Foreign Application Priority Data

Mar. 19, 1976 Germany ..... 2611743

[51] Int. Cl.[2] ..... A63C 9/08

[52] U.S. Cl. ..... 280/625

[58] Field of Search ..... 280/625

[56] References Cited

U.S. PATENT DOCUMENTS

| | | | |
|---|---|---|---|
| 3,194,574 | 7/1965 | Beyl | 280/625 |
| 3,584,891 | 6/1971 | Khazzam | 280/625 |
| 3,900,207 | 8/1975 | Iizuka | 280/625 |

*Primary Examiner*—Robert R. Song

*Attorney, Agent, or Firm*—Fleit & Jacobson

[57] ABSTRACT

A holder for engaging the toe of a ski boot on a ski comprises two jaws which can be swivelled about respective vertical pivot pins from an operative sole-engaging position to an outswung sole-releasing position against the influence of a spring biassing the jaws to the operative position. Each pivot pin is rotatable but axially non-displaceable and is provided with a screw-threaded portion engaging in a tapped hole of the associated jaw. Identical pinions carried by the pivot pins are in mesh with a common intermediate gear which can be manually rotated to adjust the level of both jaws simultaneously to suit soles of different thicknesses.

2 Claims, 2 Drawing Figures

FRONT JAW FOR SAFETY SKI BINDINGS

The invention relates to front jaws for safety ski bindings, comprising two levers which are pivotable about respective vertical pivots and have free ends in the form of holders for retaining the sole of a ski boot against outwardly and upwardly directed movement, and spring means for influencing said levers to a normal position, each said pivot being itself rotatably but axially immovably mounted on a jaw portion that is fixed with respect to the ski and being provided with a screwthread engaging in a tapped hole of the respective lever.

In known front jaws of this kind, the upper end faces of the pivots are freely accessible and provided with a slot for inserting a screwdriver with the aid of which the pivots can then be rotated to screw the levers upwardly or downwardly, depending on the direction of rotation. In this way, the holders can be adapted to soles of different thicknesses.

The disadvantage of the known front jaws is that each lever or holder must be separately adjusted. To set a pair of safety ski bindings, four separate adjustments are therefore always necessary, two for each ski. Apart from the time that this takes, there is a danger that the two levers or holders of each jaw are set to different levels. This can easily lead to one-sided clamping of the toe of the sole, thereby impairing the function and security of the front jaw.

It is an object of the present invention to avoid these disadvantages and provide a front jaw that permits the height of both levers or holders to be adjusted in a single operation.

According to the invention, the upper ends of the pivots have identical pinions secured to them which are in mesh with a manually rotatable intermediate gear that is mounted on a jaw portion fixed with respect to the ski.

In one practical embodiment of the invention, the intermediate gear may be provided at one side with a journal mounted in a complementary recess of the fixed jaw portion and held therein by a cover engaging the other side of the intermediate gear.

Figure 2:
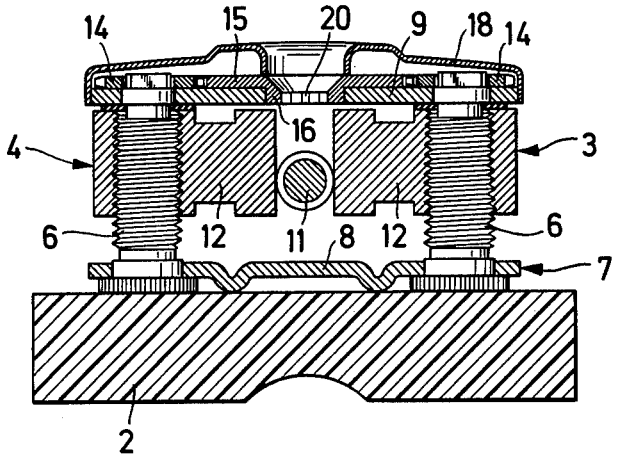
Figure 1:
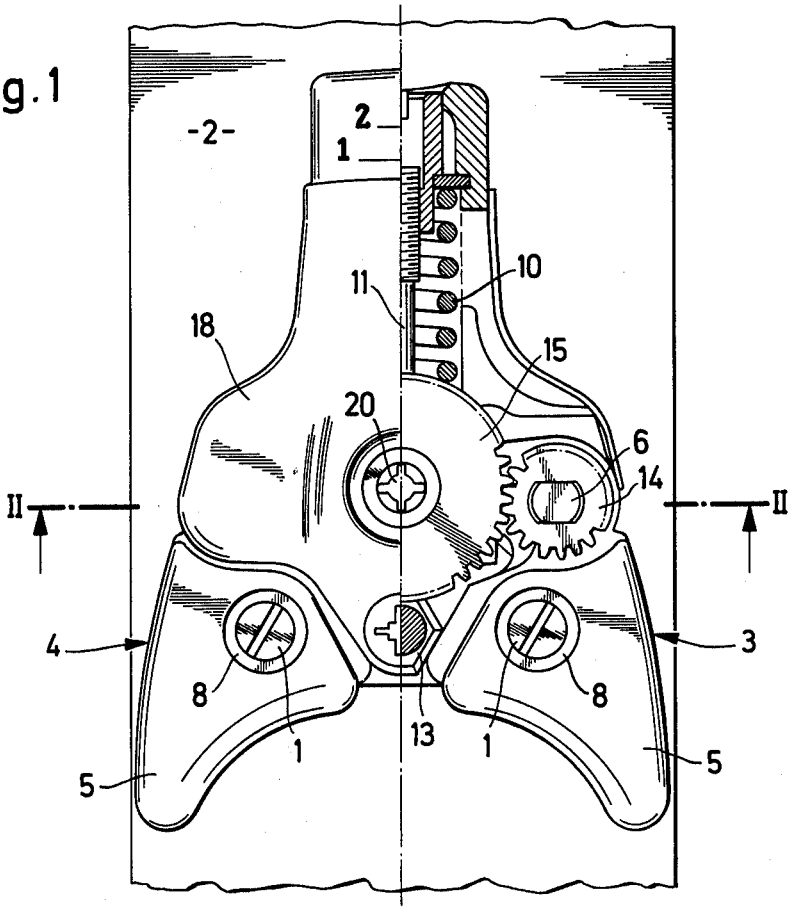

One example of the invention will now be described with reference to the accompanying drawing, wherein:

FIG. 1 is a plan view of the front jaw of which the right-hand side is shown in cross-section, and FIG. 2 is a section on the line II—II in FIG. 1.

The front jaw consists of a bent U-shaped sheet metal stamping 7 of which the limbs 8, 9 are shown in section in FIG. 2. The lower limb 8 is provided with two holes through which two screws 1 are inserted for securing the front jaw to the ski 2. Two vertical screw-threaded pins 6 are mounted in the jaw portion 7 for rotation but against axial movement. Two two-armed levers 3, 4 are pivotably mounted about the pivot pins 6, the outer free ends of the levers being in the form of holders 5 for the sole of the ski boot (not shown). To facilitate assembly of the front jaw, each holder 5 is provided with an assembly hole through which the screws 1 secured to the ski are accessible.

A yoke (not shown) connected to the pin 11 that is subjected to the spring 10 engages the inner shorter arms 12 of the two-armed levers 3, 4. The spring force that is transmitted to the shorter lever arms 12 through the pin 11 as well as the yoke tends to swivel these shorter arms towards the tip of the ski so that the free ends of the two-armed levers 3, 4 that are in the form of sole holders are held in abutment with a stop 13 provided on the jaw portion 7. The levers will thus normally assume their inner limiting position at which they are supported against the stop 13.

The screw-threaded pins 6 onto which the levers 3, 4 are screwed with the aid of complementary tapped holes are non-circular at their upper ends which pass through the limb 9 of the jaw portion 7 and each carry a positively connected identical pinion 14. The two pinions lie in one plane and are in mesh with an intermediate gear 15 which is provided on the underside with a journal 16 rotatably mounted in a complementary recess of the limb 9 of the jaw portion 7. A cover 18 secured to the jaw portion 7 holds the intermediate gear 15 against upward movement. The journal of the intermediate gear 15 is provided with a cruciform slot 20 which is accessible through an aperture of the cover 18 for inserting a screwdriver.

By means of this screwdriver, the intermediate gear 15 can be rotated, thereby rotating the screw-threaded pins 6 by way of the pinions 14. Depending on the direction of rotation, the levers 3, 4 that are pivotally mounted on the screw-threaded pins 6 are screwed either upwardly or downwardly. In this way only a single operation is now necessary to adjust the height of both levers 3, 4 and thus of the sole holder 5 of one front jaw. Both sole holders of a jaw can therefore be set merely by turning the intermediate gear 15, which prevents the sole holders from assuming mutually different elevations.

I claim:

1. A front jaw for a safety ski binding, said jaw comprising two levers which are pivotable about respective vertical pivots and have free ends in the form of holders for retaining the sole of a ski boot against outwardly and upwardly directed movement, and spring means for influencing said levers to a normal position, each said pivot being itself rotatably but axially immovably mounted on a jaw portion that is fixed with respect to the ski and being provided with a screw-thread engaging in a tapped hole of the respective lever, characterised in that identical pinions are secured to the upper ends of the pivots, said pinions being in mesh with an intermediate gear which is mounted on a jaw portion that is fixed with respect to the ski and which is rotatable by manual means.

2. A front jaw according to claim 1, characterised in that the intermediate gear is provided at one side with a journal mounted in a complementary recess of the fixed jaw portion and held therein by a cover engaging the other side of the intermediate gear.

* * * * *